US008316948B2

(12) United States Patent
Stringfellow et al.

(10) Patent No.: US 8,316,948 B2
(45) Date of Patent: Nov. 27, 2012

(54) ACTUATION ASSEMBLY FOR RISER CONNECTION DOG

(75) Inventors: Rick L. Stringfellow, Houston, TX (US); Jesse L. Bullard, Houston, TX (US); Tom A. Fraser, Spring, TX (US); Brian N. Munk, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 169 days.

(21) Appl. No.: 12/717,738

(22) Filed: Mar. 4, 2010

(65) Prior Publication Data

US 2011/0214877 A1 Sep. 8, 2011

(51) Int. Cl.
*E21B 17/01* (2006.01)
*E21B 33/038* (2006.01)

(52) U.S. Cl. ..... 166/367; 166/338; 166/341; 166/360; 166/378; 285/123.1

(58) Field of Classification Search ..... 166/367, 166/338, 339, 341, 351, 360, 378; 405/169, 405/170; 285/123.1, 123.5, 123.11, 123.9, 285/123.13, 90, 404
See application file for complete search history.

(56) References Cited

U.S. PATENT DOCUMENTS

| | | | | | |
|---|---|---|---|---|---|
| 3,345,087 | A * | 10/1967 | Hanes et al. | 285/39 |
| 3,472,538 | A * | 10/1969 | Wilder et al. | 285/374 |
| 3,606,393 | A * | 9/1971 | Huntsinger et al. | 285/90 |
| 3,768,842 | A * | 10/1973 | Ahlstone | 285/55 |
| 3,827,728 | A * | 8/1974 | Hynes | 285/90 |
| 4,068,865 | A * | 1/1978 | Shanks, II | 285/90 |
| 4,094,539 | A * | 6/1978 | Reimert | 285/309 |
| 4,606,557 | A * | 8/1986 | Coffey | 285/18 |
| 4,653,778 | A * | 3/1987 | Alandy | 285/18 |
| 5,363,931 | A * | 11/1994 | Moriarty | 175/325.5 |
| 5,456,321 | A * | 10/1995 | Shiach et al. | 166/382 |
| 5,951,066 | A * | 9/1999 | Lane et al. | 285/364 |
| 6,328,343 | B1 * | 12/2001 | Hosie et al. | 285/90 |
| 7,216,699 | B2 * | 5/2007 | Nelson et al. | 166/77.51 |
| 7,331,395 | B2 * | 2/2008 | Fraser et al. | 166/345 |
| 7,337,848 | B2 * | 3/2008 | Fraser et al. | 166/345 |
| 7,686,087 | B2 * | 3/2010 | Pallini et al. | 166/367 |
| 7,963,336 | B2 * | 6/2011 | Fraser et al. | 166/345 |
| 7,975,768 | B2 * | 7/2011 | Fraser et al. | 166/345 |
| 8,011,434 | B2 * | 9/2011 | Cosgrove et al. | 166/341 |
| 2008/0175672 | A1 * | 7/2008 | Fraser | 405/170 |
| 2010/0186964 | A1 * | 7/2010 | Reid et al. | 166/341 |

OTHER PUBLICATIONS

GE/Vetco Gray brochure, Capital Drilling Equipment, Advanced, Field-Proven Risers, Diverters and Connectors, 2008 General Electric Company.

* cited by examiner

*Primary Examiner* — Matthew Buck
(74) *Attorney, Agent, or Firm* — Bracewell & Giuliani LLP

(57) ABSTRACT

A box and pin coupling for a drilling riser having an actuator assembly with an attached dog. The actuator assembly includes an actuation rod having an end affixed to the dog. A portion of the rod is circumscribed by an annular sleeve, where the outer surface of the sleeve is threadingly attached to one of the box or pin. A shoulder is formed on the rod outer circumference between the sleeve and the end of the rod attached to the dog. A retainer cap is provided on the end of the rod opposite where it attaches to the dog. The sleeve abuts the rod on one end, and the retainer cap on the other, so that rotating the sleeve axially moves the actuation rod, that in turn moves the attached dog into or out of engagement with a profile on the other of the box or pin.

10 Claims, 4 Drawing Sheets

ACTUATION ASSEMBLY FOR RISER CONNECTION DOG

FIELD OF THE INVENTION

This invention relates in general to production of oil and gas wells, and in particular to an actuator system for a dog used in a riser connection.

DESCRIPTION OF RELATED ART

In marine riser pipe systems for use in drilling underwater well bores, pipe joints are joined together by riser couplings. Typically riser couplings include oppositely facing pin and box portions attached to adjacently located tubular sections. The box portion of one tubular telescopically fits on the pin portion of an adjacently connected tubular. Laterally moveable dog members are often used to couple together the box and pin members.

An example of a riser coupling 10 is shown in a side perspective partial sectional view in FIG. 1. The coupling 10 concludes an annular box assembly 12 shown circumscribing an upper portion of an annular pin portion 14. Although not shown, respective tubulars that form adjacent members of a drilling riser attach to opposing ends of the box portion 12 and pin portion 14. Coupling the box and pin portion assemblies 12, 14 together are a series of boss assemblies 16 disposed on the outer surface of the box portion 12. The boss assemblies 12 as shown each have an outer boss housing 18 through which an actuating screw 20 is radially inserted. A dog 22 is shown on the end of the actuating screw 20 that projects radially inward. The dog 22 includes raised sections that engage a profile 24 formed on the outer surface of the pin portion 14. Typically, threads (not shown) are provided between the actuating screw 20 and the boss assembly 16. Thus, rotating the actuating screw 20, in one direction or the other, laterally moves the dog 22 in and out of coupling engagement with the profile 24 on the pin assembly 16.

Known actuator devices can be difficult to disengage if the actuator screw is defective. For example, if the screw is cross threaded, or the threads are otherwise galled, the dog can be stuck in locking engagement thereby maintaining coupling between the box and pin portions. In some instances, the dog can become canted that can wedge it within box or the profile; known actuation assemblies can fracture when trying to pull the dog from a struck position due to a lack of tensile strength.

SUMMARY OF INVENTION

Disclosed herein is a riser connection assembly that can be made up of a receptacle adapted to be set in a riser, a pin member having a profile on its exterior and adapted to be coupled to another section of the riser, a plurality of bores extending through a sidewall of the receptacle and spaced circumferentially around the receptacle, and a plurality of dog assemblies, where each of the dog assemblies can be mounted in one of the receptacles. In one example the dog assemblies include, an elongate actuation rod having an axis, a dog on an inner facing end of the actuation rod and having a profile corresponding to the profile on the pin member, an outwardly facing shoulder on the rod that is coaxial with the axis, a sleeve circumscribing a portion of the rod and threadingly affixed to the receptacle, so that when the sleeve is rotated in a first direction, an end of the sleeve abuts the shoulder to axially move the actuation rod, that in turn moves the profile on the dog into engagement with the profile on the pin member to couple the pin and receptacle. The riser connection assembly may optionally include an end cap selectively affixable on an outer end of the actuation rod, so that when the sleeve is rotated in a direction opposite the first direction, the end of the sleeve abuts the end cap to move the actuation rod, that in turn moves the dog out of engagement with the profile and uncouples the pin and receptacle. The inner diameter of the sleeve and outer diameter of the rod may be axially slideable with respect to one another and the sleeve may optionally be freely rotatable relative to the rod. The actuator assembly can be affixed to the outer surface of the box so it projects radially inward towards the axis of the box and wherein the profile is provided on the outer circumference of the pin. A bushing may be provided on the tubular having threads on an inner circular surface that engage threads on the outer surface of the sleeve. Faceted drive flats can be on the outer surface of the sleeve, so that when a wrench engages the sleeve, the wrench couples with the flats to impart a rotational force onto the sleeve. In one example, the inner end of the actuation rod that attaches to the dog is asymmetric and non-rotating with respect to the dog.

An alternate embodiment of a riser connection assembly includes a first tubular adapted to be set in a riser, a second tubular having a profile on its exterior and adapted to be coupled to another section of the riser, a plurality of bores extending through a sidewall of the first tubular and spaced circumferentially around the receptacle, a plurality of dog assemblies each mounted in one of the first tubular. The dog assemblies can include an elongate actuation rod having an axis, a dog on an inner facing end of the actuation rod and having a profile corresponding to the profile on the pin member, an outwardly facing shoulder on the rod that is coaxial with the axis, and a sleeve circumscribing a portion of the rod and threadingly affixed to the first tubular, so that when the sleeve is rotated in a first direction, an end of the sleeve abuts the shoulder to axially move the actuation rod, that in turn moves the profile on the dog into engagement with the profile on the second tubular to couple the tubulars. An end cap may also be included with the riser connection assembly that is selectively affixable on an outer end of the actuation rod, so that when the sleeve is rotated in a direction opposite the first direction, the end of the sleeve abuts the end cap to move the actuation rod, that in turn moves the dog out of engagement with the profile and uncouples the tubulars.

Also disclosed herein is a riser string having an annular box portion affixed on an end of a first tubular member, an annular pin portion affixed on an end of a second tubular member and inserted within the box portion, a profile formed on the outer circumference of the pin portion, an actuator rod having an axis and inserted through a bore in the wall of the box portion, an outward facing external shoulder on an inner portion of the actuator rod, an inward facing external shoulder on an outer portion of the actuator rod, a dog affixed on an inner end of the actuator rod disposed within the box portion, a sleeve circumscribing a portion of the actuator rod between the inward and outward facing shoulders, and a set of external threads on the sleeve that engage threads in the hole in the wall of the box portion, so that when the sleeve is urged towards the dog, an inner end of the sleeve contacts the outward facing shoulder to move the actuator rod inward, that in turn moves the dog into engagement with the profile, and when the sleeve is rotated in an opposite direction, the sleeve contacts the outward facing shoulder to move the rod outward.

BRIEF DESCRIPTION OF THE DRAWINGS

Some of the features and benefits of the present invention having been stated, others will become apparent as the description proceeds when taken in conjunction with the accompanying drawings, in which.

Figure 1:
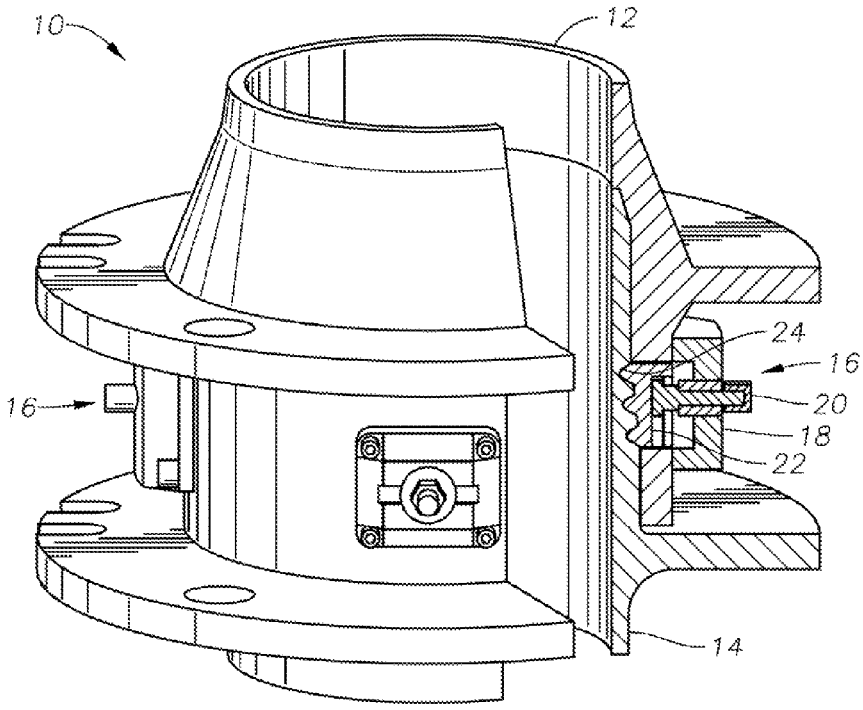
Fig. 1 (Prior Art)
FIG. 1 is an example of a prior art box and pin coupling for a riser shown in a partial sectional perspective view.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation.

Figure 2:
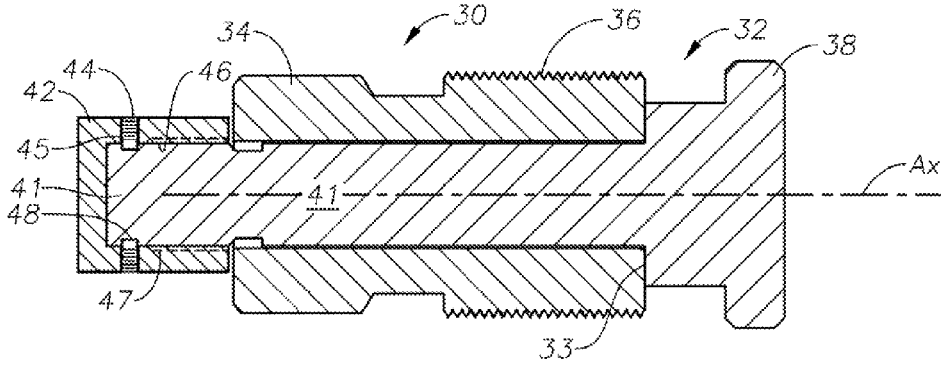
FIG. 2 is a sectional view of an example of an actuator assembly for use in a box and pin coupling.

An example of an actuation screw assembly 30 in accordance with the present disclosure is shown in a side section view in FIG. 2. In this embodiment, the screw assembly 30 includes a cylindrically-shaped actuation rod 32. The actuation rod 32 is shown having an axis $A_X$ from which its outer diameter transitions at points along its length. A shoulder 33 is shown defined where the outer diameter of the actuation rod 32 increases at a point along the axis $A_X$ to form a laterally facing surface. An annular actuation sleeve 34 circumscribes a portion of the actuation rod 32 and is shown having an end abutting the shoulder 33. Optional threads 36 are shown on the outer surface of the sleeve 34 along a portion adjacent the end next to the shoulder 33. The end of the actuation rod 32 proximate the shoulder 33 expands yet further radially outward to form an actuation head 38. The diameter of the actuation rod 32 is shown being substantially constant in a direction along its axis $A_X$ from the shoulder 33 in a direction opposite the actuation head 38; this portion of the actuation screw defines an actuation shaft 40.

A shaft end 41 is shown on the end of the actuation shaft 40 opposite the shoulder 33 and circumscribed by an end cap 42. The end cap 42 receives the shaft end 41 through an opening on one end. The end cap 42 shown has a closed end on a side opposite its open end; alternate embodiments exist that include both ends of the end cap 42 being open. Projecting radially through the walls of the end cap 42 are bores 44 with inserted set screws 45. Threads (not shown) are formed on the respective outer surfaces of the set screws 45 and the inner surface of the bores 44 so that tightening the set screws 45 within the bores 44 can secure the end cap 42 onto the shaft end 41. Threads 46, 47 may optionally be included respectively on the inner surface of the end cap 42 and outer surface of the shaft end 41. An optional groove 48 is formed on the outer surface of the shaft end 41 and formed to receive the inwardly projecting ends of the set screws 45. The end cap 42 can be fastened to the shaft end 41 in any other number of ways, such as corresponding threads on the end cap 42 and shaft end 41, fasteners that engage threaded bores within the actuation rod 32, dowels, or another or now known or later developed attachment means.

In one operational example, the actuation head 38 couples with a dog and the threads 36 engage within a threaded bore, such as within a boss assembly. Accordingly, rotating the sleeve 34 in a first rotational direction urges the sleeve 34 against the outwardly facing shoulder 33 on the actuation rod 32 to linearly move the actuation rod 32, actuation head 38, and dog to engage oppositely facing profiles within a box and pin coupling. Attaching the cap 42 onto the shaft end 41 provides a contact surface between the actuation sleeve 34 and the actuation rod 32, so that when the sleeve 34 is rotated in a direction opposite the first direction the actuation rod 32, sleeve 34, and dog are moved outward and away from the coupling. In this example the actuation rod 32 is free to axially move within the actuation sleeve 34. In one example, the threads 46, 47 oriented oppositely to the threads 36 on the sleeve 34 so that when the sleeve 34 is rotatingly remove, the cap 42 is tightened onto the shaft end 41.

Figure 3:
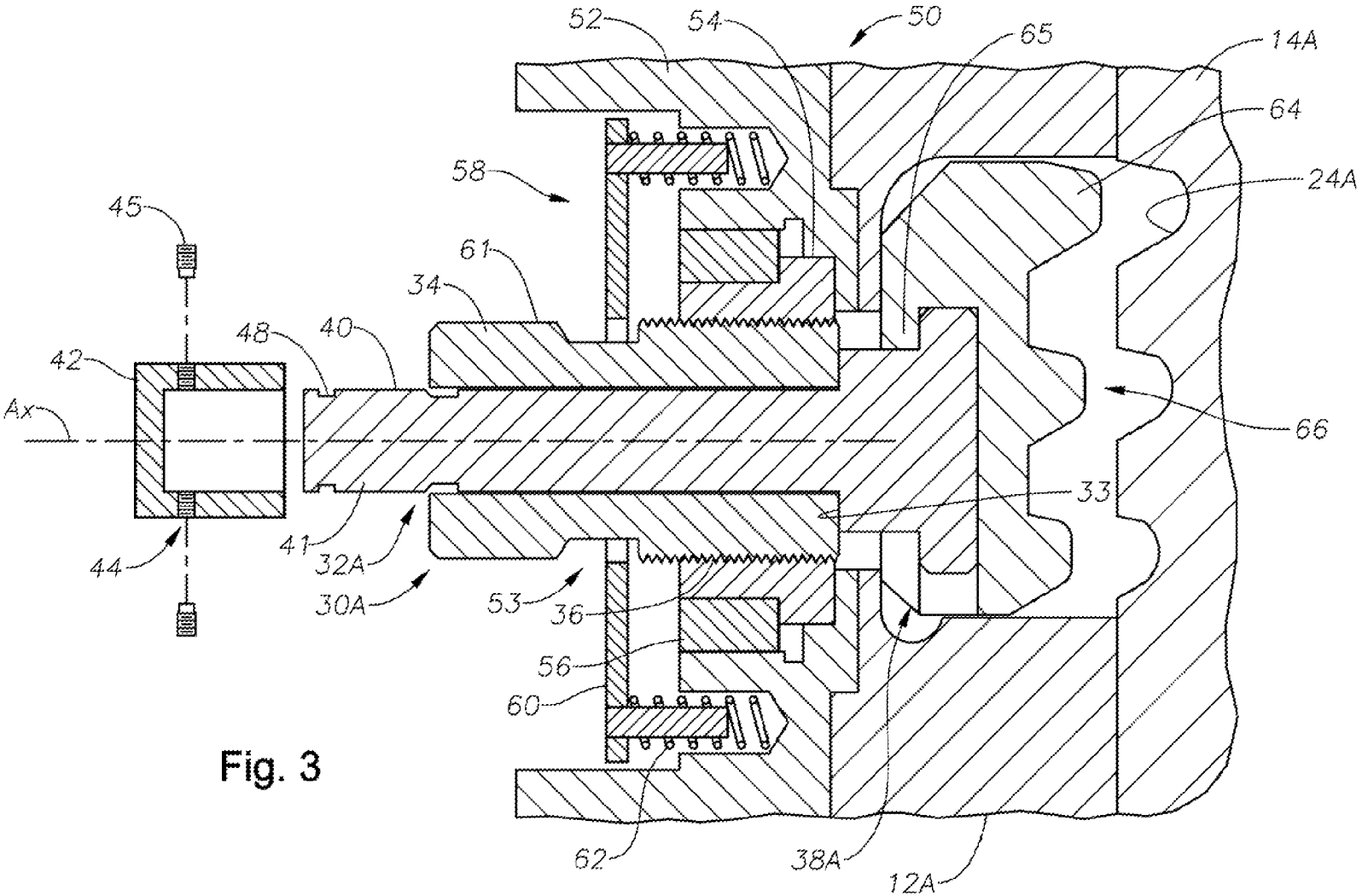
FIG. 3 is a side sectional view of an embodiment of a portion of a box and pin coupling.

An alternate embodiment of the actuation screw assembly 30A is shown combined with a boss assembly 50 in side sectional view in FIG. 3. The boss assembly 50 is shown having a housing 52 coupled to a box portion 12A. A bore 53 through the housing 52 and box portion 12A provides a path for inserting the actuation assembly 30A. An annular bushing 54 is shown set within the bore 53 on a portion where the diameter of the bore 53 transitions inward. An annular retaining collar 56 engages the box 52 by corresponding threads formed on the inner circumference of the bore 53 and outer surface of the collar 56. The retaining collar 56 coaxially fits over an upper portion of the bushing 54 and abuts a shoulder on the lower portion of the bushing 54. The sleeve 34 is shown coupled within the bushing 54 and engaged by its threads 36 with threads formed on the inner circumference of the bushing 54. Installing the retaining collar 56 as described secures the bushing 54 within the housing 52 preventing the bushing 54 from rotating within the housing 52 when the sleeve 34 engages the bushing 54.

An anti-rotation system 58 is shown circumscribing the assembly 30A that includes an anti-rotation plate 60 formed to engage faceted wrench flats 61 on the outer surface of the sleeve 34. The anti-rotation plate 60 is affixed within the housing 52 and as shown is moveable by a force along the axis of the actuation rod 32A and away from engagement with the wrench flats 61. One such example of moving the plate 60 can occur when a wrench (not shown) pushes the plate 60 inward when coupling the wrench flats 61 to rotate the sleeve 34. Springs 62 are shown compressed within recesses drilled within the housing 52. The springs 62 expand when the force is removed so the plate 60 can reengage the wrench flats 61. Inward and past the bushing 54, the diameter of the bore 53 expands outward to define a cavity in which a dog 64 is shown attached to the actuation head 38A. In this example, the actuation head 38A is asymmetric about the screw axis $A_X$ so that the actuation rod 32A cannot rotate with respect to the attached dog 64. More specifically, the upper portion 65 of the actuation head 38A inserts into a downwardly facing slot provided within the dog 64. The thickness of the upper portion 65 is less than the lower portion of the actuation head 38A, which prevents relative rotation between the actuation head 38A and dog 64. At the end of the cavity 63 opposite the bushing 54, is a pin portion 14A having a profile 24A on its facing surface formed to match a profile 66 on the inward facing side of the dog 64. Thus, laterally urging the dog 64 so that the profile 66 engages the profile 24A couples the housing 52 with the pin portion 66.

Figure 4:
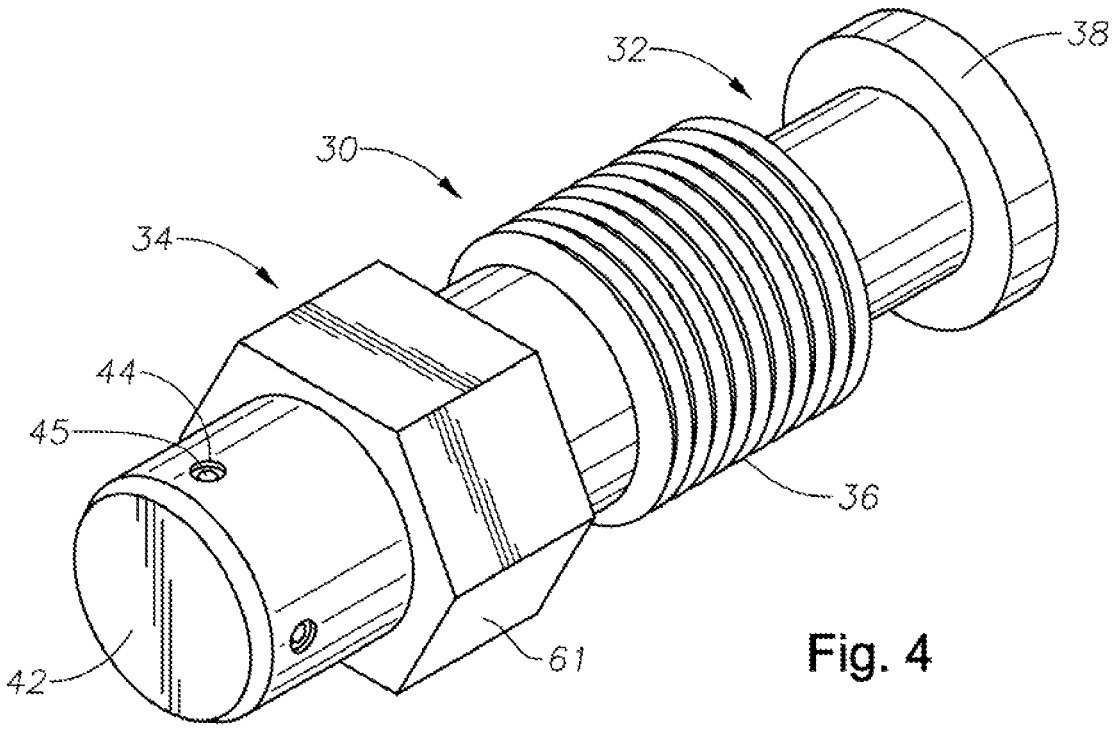
FIG. 4 is a perspective view of the actuator assembly of FIG. 2.

An example of the actuation screw assembly 30 of FIG. 2 is illustrated in a side perspective view in FIG. 4. In this example, the end cap 42 is shown secured over the shaft end 41 with the set screws 45 within the bores 44. In one example of use of the screw assembly 30, 30A of FIG. 2 or 3, a housing 52 is provided with a boss assembly 50 that includes the actuation screw assembly 30, 30A. A rotational force is applied onto the sleeve 34, such as by a wrench on the wrench flats 61, so that the threads 36 engaging the threads 54 convert the rotational motion into lateral motion, thereby urging the actuation rod 32, 32A with attached dog 64 laterally into engagement with the profile 68. As noted above, when the anti-rotation plate 60 circumscribes the portion of the sleeve 34 having the wrench flats 61, respective rotation between the sleeve 34 and housing 52 is prevented. Accordingly, the dog 64 will be prevented from disengaging the profile 68, thereby maintaining coupling between the box portion 12A and pin portion 14A.

Adding the optional end cap 42 onto the shaft end 41 axially couples the sleeve 34 and set rod 32 in an outward or disengaging direction. Thus rotating the sleeve 34 in a direction opposite that used to engage the dog 64 and profile 68, disengages the dog 64 from the profile 68 so the box and pin portions 12A, 14A may be decoupled. One of the advantages of the embodiment described herein is the tensile force used for laterally moving the dog 64 in and out of engagement with the profile 68 is distributed within the larger diameter actuation rod 32, 32A. In one example, the actuation rod 32, 32A described herein can withstand a tensile force of at least about 65,000 pounds. This significantly exceeds previously known tensile force capabilities, that were in the range of about 35,000 pounds.

Figure 5:
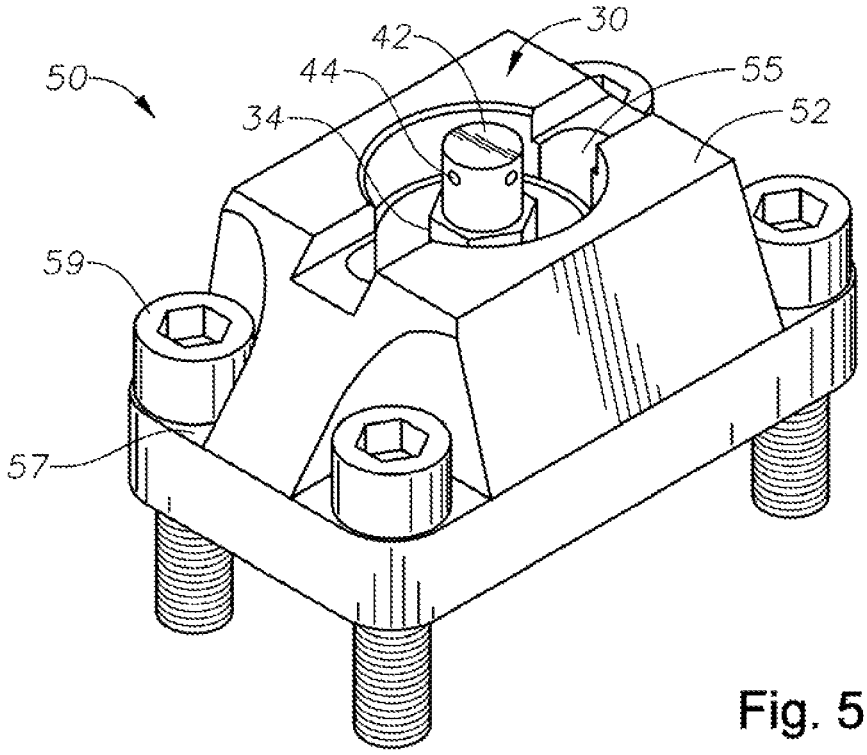
FIG. 5 is a perspective view of an example of a actuator assembly.
Figure 6:
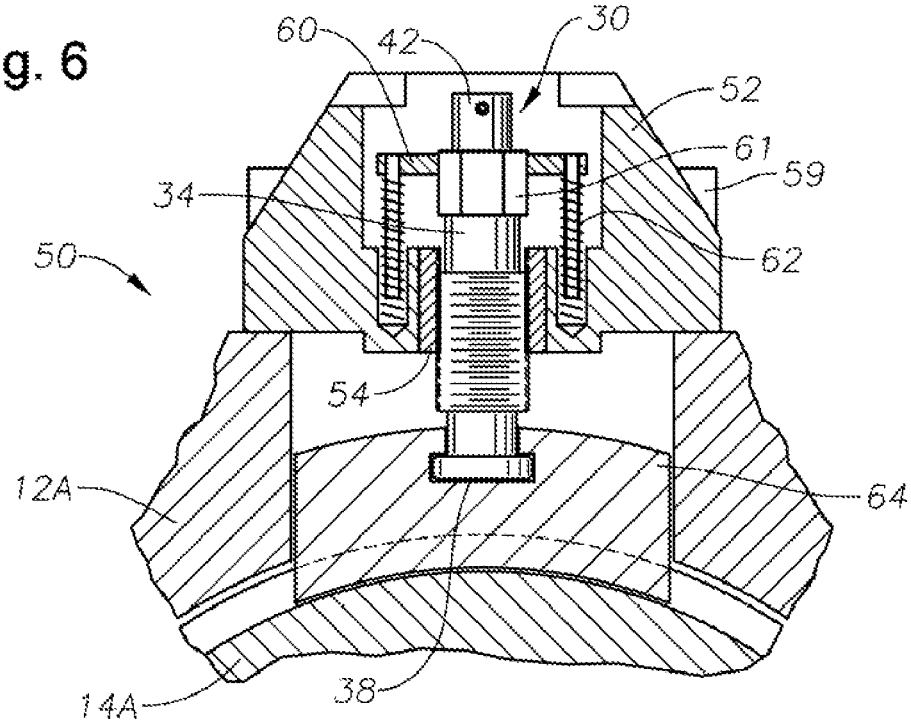
FIG. 6 is an overhead partial sectional view of the actuator assembly of FIG. 3 in an extended configuration.
Figure 7:
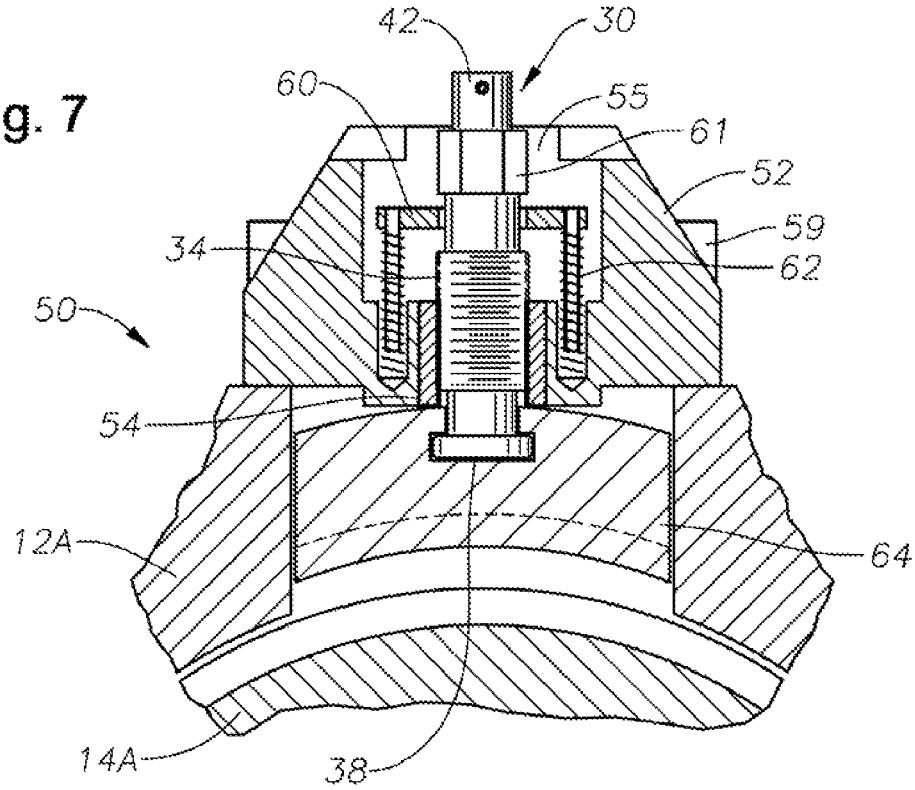
FIG. 7 is an overhead partial sectional view of the actuator assembly of FIG. 3 in a retracted configuration.

FIG. 5 illustrates in a side perspective view an example of the boss assembly 50 shown made up of the housing 52 and actuation assembly 30. The housing 52 as shown has a largely planar upper surface intersected by a cavity 55 that allows insertion of and access to the actuation assembly 30. The sides of the housing 50 angle outward from the upper surface of the housing 50 a flange 57 shown provided along outer periphery of the lower surface of the housing 30. The example of the flange 57 shown is substantially rectangular and includes bolt holes at each corner. Cap screws 59 are shown inserted through the bolt holes for attaching the boss assembly 50 to a box portion 12A (FIGS. 6 and 7). The edges of the housing 52 adjacent the bolt holes are correspondingly profiled to accommodate insertion of the cap screws 59.

FIGS. 6 and 7 are overhead partial sectional views of the boss assembly 50 attached to a box portion 12A. FIG. 6 illustrates the actuation screw assembly 30 in an extended mode with the dog 64 urged against the pin portion 14A to engage the profiles 66, 24A (FIG. 3). As shown, the actuation screw assembly 30 is positioned so that the anti-rotation plate 60 circumscribes the wrench flats 61. As described above, the actuation sleeve 34 can be rotated by sliding a socket (not shown) over the end cap 42 to engage the wrench flats 61. Inwardly urging the socket against the anti-rotation plate 60 past the wrench flats 61 frees the actuation sleeve 34 for rotation. Referring now to FIG. 7, the actuation screw assembly 30 is depicted in a retracted position; rotating the actuation sleeve 34 moves the actuation assembly 30 between the configurations shown in FIGS. 6 and 7. In the retracted position the end cap 42 is shown almost fully outside of the cavity 55 and the portion of the actuation sleeve 34 having the wrench flats 61 is proximate the opening of the cavity 55 and past the anti-rotation plate 60. Rotating the actuation sleeve 34 into the retracted position pulls the dog 64 within the box portion 12A and away from its engagement with the pin portion 14A.

The present system and method described herein, therefore, is well adapted to carry out and attain the ends and advantages mentioned, as well as others inherent therein. While a presently preferred embodiment has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A riser connection assembly comprising:

a receptacle adapted to be set in a riser;

a pin member having a profile on its exterior and adapted to be coupled to another section of the riser;

a plurality of bores extending through a sidewall of the receptacle and spaced circumferentially around the receptacle; and a plurality of dog assemblies each mounted in one of the plurality of bores of the receptacle and comprising:

an elongate actuation rod having an axis, a dog on an inner facing end of the actuation rod and having a profile corresponding to the profile on the pin member;

an outwardly facing shoulder on the rod that is coaxial with the axis;

a sleeve circumscribing a portion of the rod and threadingly affixed to the receptacle, so that when the sleeve is rotated in a first direction, an end of the sleeve abuts the shoulder to axially move the actuation rod, that in turn moves the profile on the dog into engagement with the profile on the pin member to couple the pin and receptacle, and an end cap selectively affixable on an outer end of the actuation rod, so that when the sleeve is rotated in a direction opposite the first direction, the end of the sleeve abuts the end cap to move the actuation rod, that in turn moves the dog out of engagement with the profile and uncouples the pin and receptacle.

2. The riser connection assembly of claim 1, wherein the inner diameter of the sleeve and outer diameter of the rod are axially slideable with respect to one another.

3. The riser connection assembly of claim 1, wherein the sleeve is freely rotatable relative to the rod.

4. The riser connection assembly of claim 1, wherein each of the dog assemblies is affixed to the outer surface of the receptacle and projects radially inward.

5. The riser connection assembly of claim 1, further comprising a bushing having threads on an inner circular surface engaged with threads on the outer surface of the sleeve.

6. The riser connection assembly of claim 1, further comprising faceted drive flats on the outer surface of the sleeve, so that when a wrench engages the sleeve, the wrench couples with the flats to impart a rotational force onto the sleeve.

7. The riser connection assembly of claim 1, wherein the inner end of the actuation rod that attaches to the dog is asymmetric and non-rotating with respect to the dog.

8. A riser connection assembly comprising:

a first tubular adapted to be set in a riser;

a second tubular having a profile on its exterior and adapted to be coupled to another section of the riser;

a plurality of bores spaced circumferentially apart and extending through a sidewall of the first tubular;

a plurality of dog assemblies each mounted in one of the plurality of bores of the first tubular and comprising: an elongate actuation rod having an axis, a dog on an inner facing end of the actuation rod and having a profile corresponding to the profile on the second tubular;

an outwardly facing shoulder on the rod that is coaxial with the axis;

a sleeve circumscribing a portion of the rod and threadingly affixed to the first tubular, so that when the sleeve is rotated in a first direction, an end of the sleeve abuts the shoulder to axially move the actuation rod, that in turn moves the profile on the dog into engagement with the profile on the second tubular to couple the tubulars; and an end cap selectively affixable on an outer end of the actuation rod, so that when the sleeve is rotated in a direction opposite the first direction, the end of the sleeve abuts the end cap to move the actuation rod, that in turn moves the dog out of engagement with the profile and uncouples the tubulars.

9. The riser connection assembly claim 8, further comprising threads on the end cap inner surface and outer end of the actuation rod formed in a direction opposite to the threads between the sleeve and first tubular.

10. The riser connection assembly of claim 8, wherein the tubulars are connected on their ends and includes a box on the connected end and the other tubular includes a pin on the connected end so that coupling the box to the pin couples together the tubulars.

* * * * *